US007014091B2

(12) United States Patent
Mochizuki

(10) Patent No.: US 7,014,091 B2
(45) Date of Patent: Mar. 21, 2006

(54) STAPLER APPARATUS

(75) Inventor: Naoto Mochizuki, Yamanashi Prefecture (JP)

(73) Assignees: ACCO Brands USA LLC, Lincolnshire, IL (US); NISCA Corporation, Yamanashi-Ken (JP)

( * ) Notice: Subject to any disclaimer, the term of this patent is extended or adjusted under 35 U.S.C. 154(b) by 0 days.

(21) Appl. No.: 10/477,306

(22) PCT Filed: May 31, 2002

(86) PCT No.: PCT/IB02/01927

§ 371 (c)(1),
(2), (4) Date: Nov. 11, 2003

(87) PCT Pub. No.: WO03/008160

PCT Pub. Date: Jan. 30, 2003

(65) Prior Publication Data

US 2004/0134962 A1 Jul. 15, 2004

(30) Foreign Application Priority Data

May 31, 2001 (JP) ..... 2001-165892

(51) Int. Cl.
*B27F 7/17* (2006.01)

(52) U.S. Cl. ..... 227/155; 227/120; 227/131

(58) Field of Classification Search ..... 227/154, 227/155, 156, 84, 120, 129, 131

See application file for complete search history.

(56) References Cited

U.S. PATENT DOCUMENTS

| | | | | |
|---|---|---|---|---|
| 4,199,095 | A * | 4/1980 | Yamanoi | 227/125 |
| 4,720,033 | A | 1/1988 | Olesen | |
| 4,844,319 | A * | 7/1989 | Kurosawa | 227/79 |
| 5,007,572 | A | 4/1991 | Chung-Cheng | |
| 5,141,143 | A * | 8/1992 | Ebner et al. | 227/129 |
| 5,230,457 | A | 7/1993 | Hiroi et al. | |
| 5,346,114 | A * | 9/1994 | Udagawa et al. | 227/120 |
| 5,791,544 | A * | 8/1998 | Fujimaki | 227/7 |
| 5,806,750 | A | 9/1998 | Yamanushi et al. | |
| 6,050,471 | A * | 4/2000 | Yagi | 227/119 |
| 6,250,531 | B1 * | 6/2001 | Yagi | 227/79 |
| 6,343,785 | B1 | 2/2002 | Yamada et al. | |
| 6,371,352 | B1 * | 4/2002 | Mochizuki | 227/155 |
| 6,626,348 | B1 * | 9/2003 | Kitamura | 227/155 |
| 6,681,975 | B1 * | 1/2004 | Yamaguchi | 227/82 |
| 6,705,504 | B1 * | 3/2004 | Kanai et al. | 227/135 |

* cited by examiner

*Primary Examiner*—Scott A. Smith
(74) *Attorney, Agent, or Firm*—Michael Best & Friedrich LLP

(57) ABSTRACT

A stapler apparatus includes a fixed frame, a movable frame pivotably mounted to the fixed frame, a staple driving device, and a staple bending device to bend the staples. A drive mechanism reciprocally moves the movable frame with respect to the fixed frame to clamp a stack of sheets between the fixed frame and the movable frame. A transmission member is movably supported on the movable frame without any connection utilizing an elongated slot. An urging member is disposed to bias the transmission member with respect to the movable frame, the transmission member being coupled to the drive mechanism such that the drive mechanism engages and moves the transmission member with respect to the movable frame, thereby overcoming the bias of the urging member, to compensate for a stack height of the stack of sheets clamped between the fixed frame and the movable frame.

20 Claims, 12 Drawing Sheets

27a, 27b = Activating levers
28a, 28b = Abutting protrusions
30 = Anvil unit
32a, 32b = Anvil arms
38a, 38b = Second swing pivots
39a, 39b = Second springs

STAPLER APPARATUS

DETAILED DESCRIPTION OF THE INVENTION

1. Field of Application

The present invention relates to a stapler apparatus for stapling a bundle of predetermined sheets put thereon with motor-driven staple driving means.

2. Prior Art

Previous stapler apparatuses for automatically stapling a sheet bundle with staples have a fixed frame and a movable frame attached swingably thereto. Either one of the frames has staple driving means, and the other has staple bending means for bending ends of the staple. In the course that the fixed frame and the movable frame clamp the sheet bundle, the staple driving means forms the linear staples to a U-shape. After that, the staple bending means bends the ends of the staple passed through the sheet bundle. Cam members are provided and interlocked with a drive motor for the operations of the movable frame to clamp the sheet bundle and of the staple driving means to drive the staple into the sheet bundle. That is, the movable frame separated with a predetermined distance is moved close to the fixed frame until it contacts a surface of the sheet bundle before driving the staple in. It is known that the movable frame may have the staple driving means or the staple bending means mounted thereon.

In either type, it is needed that the movable frame is positioned with the predetermined distance from the fixed frame, places the sheet bundle onto the fixed frame, then comes close to the fixed frame, and drives the staple into the sheet bundle with it abutted to the surface of the sheet bundle. The cam members perform the clamping operation of clinching the sheet bundle. Therefore, the cam members and the movable frame must be interlocked together with levers or similar transmission members. The movable frame is different depending on thickness of the sheet bundle in movement distance from a home position (initial position) to the contact position at the surface of the sheet bundle. The moving distance is short for thick sheet bundle and long for thin one. The previous way of interlocking the cam members with the movable frame, as disclosed in, for example, Japanese Laid Open Patent Tokkai Hei 9-169006, is that a transmission member is disposed with one end thereof fitted to the cam member and the other fitted to the movable frame to transmit movement of the cam to the movable frame. In mounting the transmission member (usually lever member) on the fixed frame rotatably by a shaft, the shaft of the transmission member is put in a long hole formed on the fixed frame and is urged to the cam face by a spring as in the long hole. Therefore, the movable frame is swung by the cam with a center of an axis of the fixed frame when it is not resisted by anything. The movement of the cam is transmitted to the movable frame with the transmission member rotating with the center, prompting the movable frame to do the clamping movement. When the movable frame abuts against the surface of the sheet bundle and cannot move any more, excess movement of the cam face serves for the shaft of the transmission member to resist against the spring force to move in the long hole, and the movable frame fits to the cam face with the center of the end abutting on the sheet bundle, allowing only the end to move.

Problems to be Solved by the Invention

As described above, such a previous method is disadvantageous in that in transmitting the movement of the driving cam to the movable frame by swinging of the transmission member, the shaft as the center for swinging is thrust-moved in the long hole to adjust the movement distance with the thickness of the sheet bundle. This may not allow the shaft to move smoothly in the long hole, but locks the drive system. The failure is due to looseness of the members until abutting from the driving cam to abutting of the movable frame on the sheet bundle and due to frequent non-smooth movement of the transmission member for rotation and thrusting depending on abutting condition of the movable frame on the sheet bundle. In particular, such an arrangement as the driving cam and the long hole for supporting the transmission member and the driving cam are paired right and left, is devised so that the shafts of the transmission members are passed through the right and left long holes to serve for centers of rotation and thrusting movement. Dispersion of parts of the paired members will cause the failure increase.

In view of solving the foregoing problems of the prior arts, it is an object of the present invention to provide a stapler apparatus that clamping of the sheet bundle is smoothly shifted to staple driving operation at little failure occurrence irrespective of thickness of the sheet bundle.

Means to Solve the Problems

The stapler apparatus according to claim 1 of the present invention is for clamping sheet bundles between a fixed frame and a movable frame for binding, equipped with a fixed frame, a movable frame pivotably mounted to the fixed frame, a staple driving means disposed on one of the fixed frame and the movable frame, a staple bending means for bending the leading ends of staples disposed on the other and a drive cam means for reciprocally moving the movable frame, wherein a transmission member comprising an abutting portion to abut one end of the movable frame, mounted rotatably pivoted to the movable frame, an activating member reciprocated by the drive cam means, interlocked to the drive cam means, and an urging means to urge the transmission member so that the abutting portion abuts the movable frame, and wherein the activating member abutting the transmission member so that the activating means separates the abutting portion from the movable frame resisting the urging means.

The invention according to claim 2 is equipped with a fixed frame, a movable frame pivotably swinging on the fixed frame, a staple driving means disposed on one of the fixed frame and the movable frame, a staple bending means to bend the leading ends of staples disposed on the other, and a drive cam means to reciprocally move the movable frame, to clamp sheet bundles between the fixed frame and the movable frame and to bind sheet bundles, wherein the movable frame is rotatably supported by a shaft on one point to the fixed frame, a transmission member comprising an abutting portion to abut the movable frame, rotatably supported on a shaft on one point on the movable frame, an urging means is disposed to urge the transmission member so that the abutting portion abuts the movable frame, the transmission member interlocked to the drive cam to separate the abutting portion from the movable frame in resistance to the urging means.

With the invention of claims 1 and 2, adjustment of the movement distance depending on thickness of the sheet bundle is not made by moving the swinging shaft of the movable frame, but by use of turning of the transmission member supported swingably by shaft on the movable frame. This feature does not need the thrusting movement of the swinging fulcrum shaft of the movable frame in the long hole as in the previous apparatus. For the reason, the shaft will not be caused in the failure that it does not move smoothly in the long hole, not resulting in locking of the drive system. Also, it is advantageous that smooth operations are assured as not affected by dispersion of parts of the members because of just swinging.

The stapler apparatus according to claim 3 of the present invention is characterized in that in the stapler apparatus in claim 1, the urging means is made up of a spring member disposed between the movable frame and the transmission member.

According to the invention, the spring member disposed between the movable frame and the transmission member is stretched by adjustment of the movement distance depending on thickness of the sheet bundle. The reaction serves for clamping the sheet bundle. This means that even for clamping only one sheet, minimum necessary clamping force can be obtained not to escape the sheet when driving the staple into the sheet.

The stapler apparatus according to claim 4 of the present invention is characterized in that in the stapler apparatus in claim 1, the urging means is made up of a spring member disposed between the transmission member and the fixed frame.

According to the invention, as the spring member does not swing together with the movable member, they can be easily arranged even in limited space.

The invention according to claim 5 is characterized in that in the stapler apparatus in claim 1 or 2, each of said movable frame and the transmission member is paired with distance from the fixed frame respectively.

According to the invention, as the paired movable frame and the paired transmission members are disposed to have the fixed frame therebetween and are urged by the respective spring members, smooth swinging operation can be made without deviation.

Embodiments

The following describes an embodiment of the stapler apparatus of the present invention by reference to the accompanying drawings. FIG. 1 is a perspective view of an overall structure of a stapler apparatus of the present invention. FIG. 2 is a side view of the stapler apparatus shown in FIG. 1. FIG. 3 is a perspective view of main units of the stapler apparatus, including a driver unit and an anvil unit. FIG. 4 is an exploded perspective view of main parts of the driver unit. FIG. 5 is a perspective view of main units of the stapler apparatus, including a driver unit and an anvil unit. FIGS. 6 through 8 are views of main parts of drive structure of the anvil unit.

The stapler apparatus 10 in the embodiment, as shown in FIGS. 1 and 2, has a U-shaped fixed frame 11 forming the stapler apparatus 10, a driver unit 20 having drive cam means for driving a staple driving member and a staple bending member as built in the fixed frame 11, an anvil unit 30 having a movable frame as supported rotatably with respect to the fixed frame 11, and a staple supply unit 40 arranged detachably at a rear of the fixed frame 11. The driver unit 20 is structured so as to separate staples one by one from the sheet-like staple band having many staples interlocked together like a band, to form the separated staples to a U-shape, and to drive in thickness direction the staples into the sheet bundle fed in the anvil unit 30 positioned above. The anvil unit 30 arranged against the driver unit 20, on the other hand, is structured so as to receive both ends of the staple driven in the sheet bundle before to bend the both ends inward, thereby finally stapling the sheet bundle.

The fixed frame 11 has a mount 12 disposed for mounting a staple supply unit 40 at a rear thereof and has a sheet table 13 for bundling sheets at a front thereof. The fixed frame 11 also has a driver unit 20 for driving sheet-like staples fed from the staple supply unit 40 therein and has a drive motor for driving the driver unit 20 therein. The staple supply unit 40 has a cassette 41 containing the staples interlocked together like a sheet and has a holder 42 for containing the cassette 41, being detachably mounted on a mount 12 of the fixed frame 11. The driver unit 20 is described below in detail by reference to FIGS. 3 through 5. The driver unit 20 comprises a drive motor 21, deceleration gears 22, a first cam member 23, a second cam member 24, and a driver 60. The deceleration gears 22, the first cam member 23 and the second cam member 24 are assembled in a housing 25 having a partition wall therein and are swingably supported by an outside wall and the partition wall. The drive motor 21 is made up of a single dc motor an output gear 21*a* of which has the deceleration gears 22 interlocked thereto. The deceleration gears 22 comprise a first deceleration gear 22*a*, a second deceleration gear 22*b*, a third deceleration gear 22*c*, a fourth deceleration gear 22*d*, a fifth deceleration gear 22*e*, a sixth deceleration gear 22*f*, and a seventh deceleration gear 22*g* as looked outward from the output gear 21*a*. The sixth deceleration gear 22*f* is a final gear stage to swing the first cam member 23. The seventh deceleration gear 22*g* is a final gear stage to swing the second cam member 24.

Both the first cam member 23 and the second cam member 24 are formed of the same member and arranged in parallel with the drive motor 21. The first cam member 23 and the second cam member 24 are made up of drive gears 23*a* and 24*a* that have the torque to rotate in different directions by the sixth deceleration gear 22*f* and the seventh deceleration gear 22*g*, eccentric cams 23*c* and 24*c* that are fitted via shafts 23*b* and 24*b*, and rotating cams 23*e* and 24*e* for reciprocally moving the driver 60, respectively. The eccentric cams 23*c* and 24*c* are shaped virtually semicircle, peripheries of which drives the anvil unit 30 to swing. The eccentric cams 23*c* and 24*c* also have clincher swinging shafts 23*d* and 24*d* projected thereout for swinging a clincher unit disposed inside the anvil unit 30, respectively. The rotating cams 23*e* and 24*e*, on the other hand, are rotatably supported by the eccentric cams 23*c* and 24*c* and engaging pins 23*f* and 24*f* and are rotated in synchronization with the drive gears 23*a* and 24*a*. The rotating cams 23*e* and 24*e* have driver swinging pins 23*g* and 24*g* arranged symmetrically in a standing condition at positions separated from centers thereof on front surfaces thereof, respectively. The driver swinging pins 23*g* and 24*g* are engaged with slits 62*a* and 62*b* opened on a driver body 61, respectively. As described above, the first cam member 23 and the second cam member 24 operate the anvil unit 30, the clincher unit 50, and the driver 60 at the same time.

The driver 60, as shown in FIGS. 3 through 5, is made up of the driver body 61 having a paired horizontally long right and left slits 62*a* and 62*b* of identical shape formed thereon and of a vertically long driver head 63 disposed orthogonally with the driver body 61. The driver head 63 is formed of a plate material thickness which is virtually same as the staple at a leading edge 64 thereof. The driver head 63 has a long hole 65 for engaging a staple forming member 77 (which will be described later) in a longitudinal direction at a central portion thereof and has guide plate springs 66*a* and 66*b* disposed for engaging with the staple forming member 77 to press in while driving the staple.

The driver 60 formed as described above moves the driver head 63 one reciprocal stroke while the driver swinging pins 23*g* and 24*g* fitted with the respective slits 62*a* and 62*b* of the driver body 61 rotate one turn. This completes stapling operation. The driver swinging pints 23*g* and 24*g* are symmetrically put not to deviate an acting point for the driver 60. As described above, the driver 60 features that the rotations of the rotating cams 23*e* and 24*e* arranged symmetrically make upward or downward pushing while moving the acting points in sequence, not causing the driver head 63 to shake right or left. This allows the staples to pass securely through even a large amount of sheet bundle.

The anvil unit 30, as shown in FIG. 5, is made up of an anvil 31 for pressing the sheet bundle and paired movable frame (hereinafter referred to as anvil arms 32*a* and 32*b*) extended from respective ends of the anvil 31 for pinching both sides of the fixed frame 11. The anvil 31 has a flat sheet pressing surface 33 and a clincher covered with a cover 34 on the sheet pressing surface 33. The anvil arms 32*a* and 32*b* are made swingable with centers of first swing pivots 35*a* and 35*b* supported axially at the fixed frame 11. It should be noted that the anvil arms 32*a* and 32*b* and the fixed frame 11 are urged at their respective lower ends by the first spring 36*a* and 36*b* as shown in FIGS. 1 and 2 so that the anvil 31 can be placed at a position opened for the sheet table 13 to put the sheet bundle therein in normal state.

The anvil unit 30, as shown in FIGS. 3 and 5, has an activating member (hereinafter referred to as anvil swinging shaft 37) swung as being made to abut on peripheries of the eccentric cams 23*c* and 24*c* in the driver 20 and by virtually elbowed transmission members (hereinafter referred to as activating levers 27*a* and 27*b*) made to abut on the anvil swinging shaft 37. The activating levers 27*a* and 27*b*, as shown in FIGS. 5 and 6, have respective ends of the anvil arms 32*a* and 32*b* supported by shaft at second swing pivots 38*a* and 38*b*. The activating levers 27*a* and 27*b* are fitted at ends thereof with respective abutting protrusions 28*a* and 28*b* disposed to project on respective ends of the anvil arms 32*a* and 32*b* as urged by second springs 39*a* and 39*b*. Swinging of the activating levers 27*a* and 27*b*, as shown in FIG. 7, is made by the anvil swinging shaft 37 abutted on the peripheries of the eccentric cams 23*c* and 24*c*. The anvil swinging shaft 37 is reciprocally moved up and down once while contacting the peripheries of the eccentric cams 23*c* and 24*c* as the eccentric cams 23*c* and 24*c* rotate one turn. Such a vertical reciprocal movement resists against the first spring 36*a* and 36*b* urged to the fixed frame 11 to press down the activating levers 27*a* and 27*b*. The anvil arms 32*a* and 32*b* are moved down with centers of the first swing pivots 35*a* and 35*b* to clamp the sheet bundle put on the sheet table 13.

FIG. 8 is views of another embodiment of the anvil swinging shaft. The anvil swinging shaft 37*a* in the embodiment has small rollers 23*k* and 24*k* built thereon in parallel with the paired shafts 23*b* and 24*b*. The rollers 23*k* and 24*k* are supported to contact peripheries of the eccentric cams 23*c* and 24*c*. Such an anvil swinging shaft 37*a* allows for further smooth rotations of the eccentric cams 23*c* and 24*c* and less noise during driving as having the rollers 23*k* and 24*k* arranged.

The following describes operation of the anvil unit 30 by reference to FIG. 9. The figures for steps a through e are views showing a clamping operation of the sheet bundle, particularly in movements of the paired anvil arm 32*a* and the activating lever 27*a*. The following description is for the component members and symbols on one side, but same as on the other sides. Steps a through c described below are of operations of clamping the sheet bundle.

Step a. The figure shows a state before clamping the sheet bundle. The anvil 31 is stopped at a position farthest from the sheet table 13. The anvil arm 32 in the state is urged to swing clockwise with a center of the first swing pivot 35*a* by the first spring 36*a* as the anvil swinging shaft 37 is at a position escaped from the cam face of the above-mentioned eccentric cam 23*c*. The anvil swinging shaft 37 is brought up to a highest position by the activating lever 27*a* abutting on the abutting protrusion 28*a* on the anvil arm 32*a* by the second spring 39*a*, the activating lever 72*a* being supported by shaft with a center of the second swing pivot 38*a* together with the anvil arm 32*a*. In such a state, the anvil arm 32*a* abuts on a stop of an apparatus frame (not shown) by the first spring 36*a* to keep in the initial state that opens a space available for loading the bundle of maximum allowable sheets to staple.

Step b. When a staple start signal is received from an external apparatus with the sheet bundle placed in position on the sheet table 13 in step a before, the eccentric cam 23*c* starts rotation. At the same time, the anvil swinging shaft 37 presses down the activating lever 27*a* to resist against the first spring 36*a*. Then the anvil arm 32*a* starts turning toward the sheet table 13 with the center of the first swing pivot 35*a*. In the event, the second spring 39*a* turns the activating lever 27*a* and the anvil arm 32*a* together. The state becomes one that the maximum allowable bundle sheets can be stapled.

Step c. The anvil arm 32*a* turns further. The figure shows the state that zero to several sheets are clamped.

The following steps d and e are for a bundle thickness absorption operation to adjust the moving distance for thickness of the sheet bundle with turning of the eccentric cam 23*c* after clamping the sheet bundle at steps b and c above.

Step d. First, when the anvil 31 clamps the sheet bundle of a desired thickness in the state of step b, the anvil arm 32*a* stops swinging once. Even in the state, the eccentric cam 23*c* continues rotation further to press the anvil swinging shaft 37 downward. This resists against urging of the second spring 39*a* to rotate the activating lever 27*a* counterclockwise until the eccentric cam 23*c* rotates one turn. Also the reaction given by the rotation of the activating lever 27*a* resisting against the urging force of the second spring 39*a* allows the anvil 31 to clamp the sheet bundle. This completes the clamping operation the force of which is enough not to escape the sheet bundle when the staple is driven in upward. The clamping operation also prevents the activating lever 27*a* and the eccentric cam 23*c* from being damaged.

Step 3. The figure shows the state that the sheet bundle is thinner than at step d. The operation is similar to step d above. Description is omitted.

As explained above, the anvil unit 30 having the arrangement mentioned above can perform secure clamping operation irrespective of the thickness of sheet bundle.

The cover 34 of the anvil 31 has the clincher unit 50 disposed therein. The clincher unit 50 is an arrangement for bending edges of the staples passed through the sheet bundle by the driver head 63 inside the driver 60. The clincher unit 50, as shown in FIG. 10, is made up of paired clinchers 51*a* and 51*b* for guiding to open and close the both edges of the staples, a clinch plate 52 for pressing at centers of clinchers

51*a* and 51*b* to bend the both edges of the staples, and a U-shaped clinch arm 53 supported swingably at the first swing pivots 35*a* and 35*b* of the anvil arms 32*a* and 32*b*. The clinch arm 53 is rotatably supported at the first swing pivots 35*a* and 35*b* on the fixed frame 11 together with the anvil arms 32*a* and 32*b*. After the anvil arms 32*a* and 32*b* support the sheet bundle by clamping it, the clinch arm 53 is independently swung with centers of the first swing pivots 35*a* and 35*b* by joint levers 26*a* and 26*b* interlocked with the clinch swinging pins 23*d* and 24*d*. The clinch arm 53 then moves the clinch plate 52 interlocked with the clinch arm 53. The joint levers 26*a* and 26*b*, as shown in FIG. 2, are rotatably supported at the respective swing pivots of the anvil arms 32*a* and 32*b* and the clinch arm 53. The joint levers serve to transmit swinging of the first cam member 23 and the second cam member 24 in the driver unit 20 to the anvil unit 30 and the clinch unit 50.

FIG. 11 shows a staple feeding arrangement 70 for sequentially feeding the band-shaped staples 43 held in the staple supply unit 40 toward the driver 60 and the clincher unit 50. The staple feeding arrangement 70 has a staple feeding lever 71 supported swingably on the fixed frame 11 via the staple swinging shaft 73, a staple feeding pawl 72 disposed at an end of the staple feeding lever 71, and a plate spring 74 for urging the staple feeding lever 71 to a predetermined position. Feeding the band-shaped staple 43 is made by rotating the drive gears 23*a* and 24*a* with the drive motor 21. The rotation allows staple feeding pings 23*h* and 24*h* mounted to stand at the drive gears 23*a* and 24*a* pushes rightward the staple feeding lever 71 supported to resist against the plate spring 74. This hooks the staple feeding pawl 72 on the staples 43. When the drive gears 23*a* and 24*a* are rotated, further, the staple feeding pins 23*h* and 24*h* are taken out of the staple feeding lever 71, which is then pushed back leftward by force of the plate spring 74. In such an operation, the staples 43 are fed out toward a bending block 75 (which will be later) by the staple feeding pawl 72.

The staples 43 moved forward sequentially by the staple feeding arrangement 70, as shown in FIG. 12, are abutted against a staple catching groove of the square bending block 75 disposed at a front of the fixed frame 11. A staple forming member 77 placed through a homer pin 76 at a long hole 65 of the driver head 63, then can form the staple 43 to U-shape as the driver head 63 moves up. After that, the both side plate springs 66*a* and 66*b* on the driver head 63 are moved on guide blocks 78*a* and 78*b*. This disengages the plate springs 66*a* and 66*b* from the staple forming member 77. Only the driver head 63 pushes up the U-shaped staple 43 onto the anvil 31 positioned further upward to pass it through the sheet bundle. The clincher unit 50 bends the both legs of the staple 43, completing the stapling operation.

FIG. 13 shows the sequential stapling operation of the stapler apparatus 10 as looked to the front thereof. The following describes operation steps in the order shown in the figure.

a. Initial State

This shows a state right before start of the stapling operation. The staple 43 is fed under the bending block 75 by the means described by reference to FIGS. 11 and 12. The sheet bundle 79 is aligned on the sheet table 13. The driver 60 is put at a home position at the bottom, while the anvil 31 is open as separated away from the sheet bundle 79.

b. Sheet Bundle Clamping State

When a stapling start signal is received in the state a above, the paired rotating cams 23*e* and 24*e* start rotation in arrow directions. The rotations of the rotating cams 23*e* and 24*e* make the driver swinging pins 23*g* and 24*g* press the driver 60 up. At the same time, through the serial operations shown in FIG. 9, the anvil 31 moves down to clamp the sheet bundle 79 in the sheet table 13.

c. Staple Forming State

The staple forming member 77 bends upward the both ends of the staple 43 put on the bending block 75 as interlocked with upward movement of the driver 60 in step b above.

d. Stapling Start State

The driver 60 and the staple forming member 77 are disengaged from the state at step c above. Only the driver 60 moves up. The end 64 on the driver head 63 then is butted against the U-shaped staple 43. The staple 43 is at the state right before being driven into the sheet bundle 79.

e. Stapling Setup State

When the driver 60 moves up further from the state at step d above, the both ends on the U-shaped staple 43 are passed through the sheet bundle 79 and run into the clinchers 51*a* and 51*b*, allowing clinching to start.

f. Clinching State

Finally, the clinching plate 52 is pushed down to bend the both ends of the staple inward. This ends the sequence of stapling operations.

The operations at steps a to f can be completed in a single turn of the driver swinging pins 23*g* and 24*g* made to stand on the rotating cams 23*e* and 24*e*. As described so far, the stapler apparatus 10 according to the present invention is excellently stable as the drive parts are driven by the two systems of cam members 23 and 24 of identical members. In particular, the rotating cams 23*e* and 24*e* and the driver swinging pins 23*g* and 24*g* for driving the driver 60 can perform smooth driving as they are symmetrical in shape and position.

FIG. 14 is a timing chart illustrating the sequential operations of the stapler apparatus. The sequential operations are described below by reference to FIGS. 14, 2, and 3 through 5. The drive motor 21 starts rotation as receiving the stapling start signal from an apparatus body (not shown). The drive motor 21, as shown in FIG. 3, transmits rotational torque through the deceleration gears 22 to the first cam member 23 and the second cam member 24. The first cam member 23 and the second cam member 24 start swinging of the anvil unit 30 first, which is large in amount of swinging. The sheets are clamped in a range of an amount of swing for two sheets (85 degrees of the sixth deceleration gear 22*f*) to an amount of swing for 50 sheets shown by dotted line in the figure. In the start, swinging of the anvil swinging shaft 37 butted against the eccentric cams 23*c* and 24*c* is absorbed by the second springs 39*a* and 39*b* as the anvil unit 30 clamps the sheet bundle not to swing further. The driver 60 driven by the rotating cams 23*e* and 24*e* is moved a little later after swinging of the anvil unit 30. The staple forming member 77 interlocked with the driver 60 forms the staples 43 to U-shape before the driver head 63 drives the U-shaped staple 43 in position on the sheet bundle. After driving, the clincher unit 50 is returned up first by spring force together with release of the cam members. Then the anvil unit 30 also is returned up by spring force together with release of the cam members. At the same time, also, the driver unit 20 is returned down with release of the cam members, being reset to the home position.

The embodiments described so far have the anvil unit 30 swung to clamp the sheet bundle between it and the driver unit 20 placed in position. Alternatively, of course, the driver unit 20 can be swung, and both the driver unit 20 and the anvil unit 30 can be swung one another.

SYMBOLS

Figure 1:
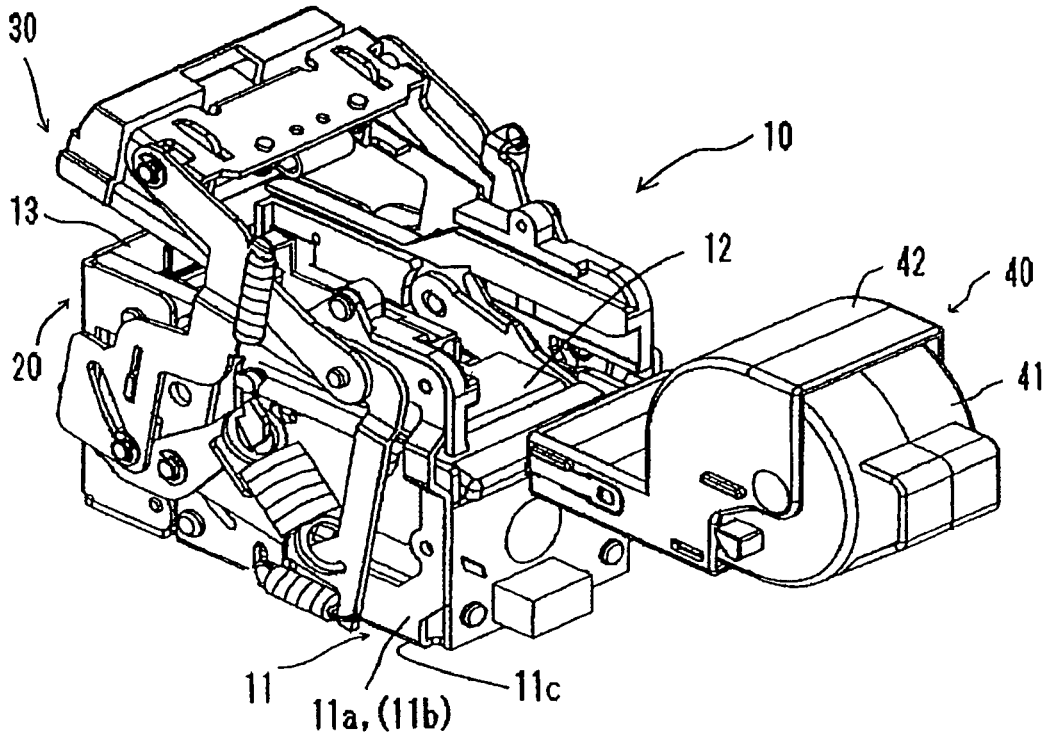
FIG. 1 is a perspective view of an overall structure of a stapler apparatus of the present invention.
Figure 2:
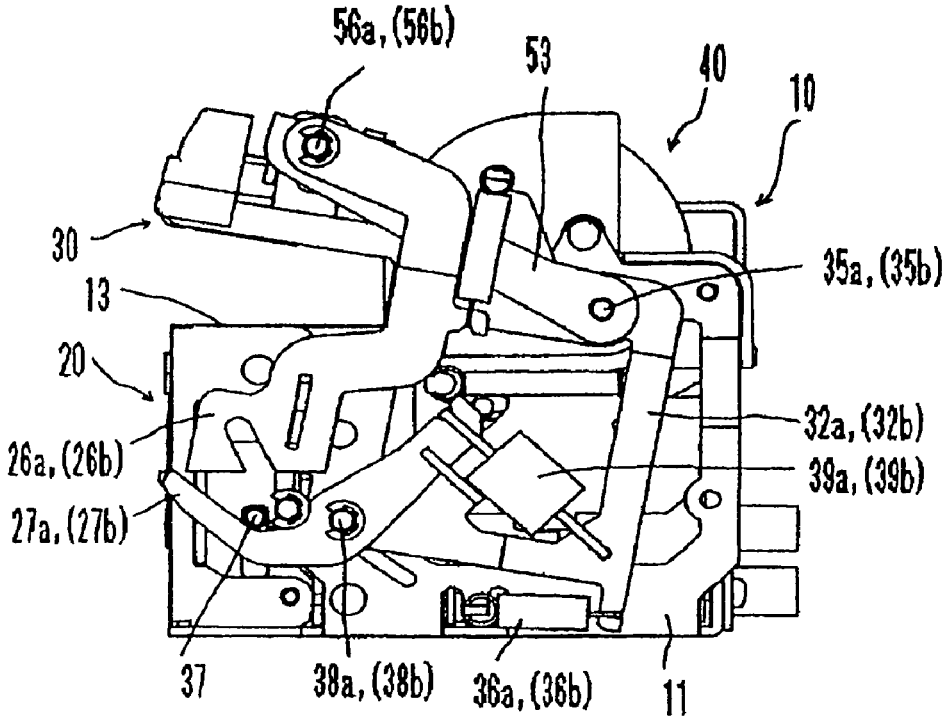
FIG. 2 is a side view of the stapler apparatus shown in FIG. 1.
Figure 3:
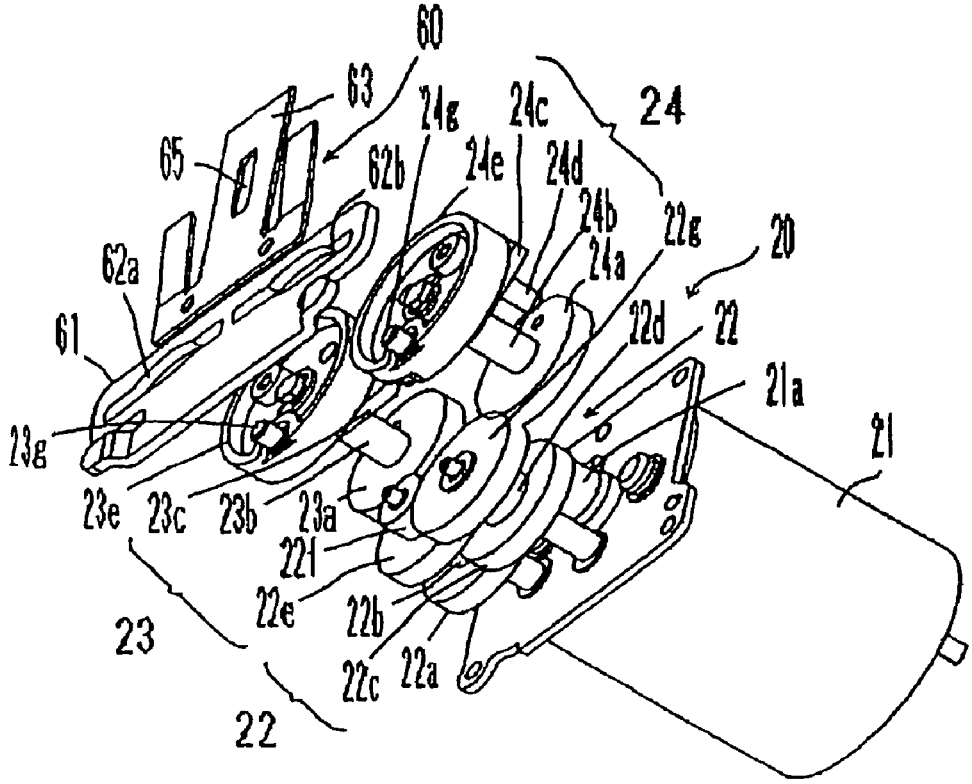
FIG. 3 is a perspective view of main parts of the driver unit.
Figure 4:
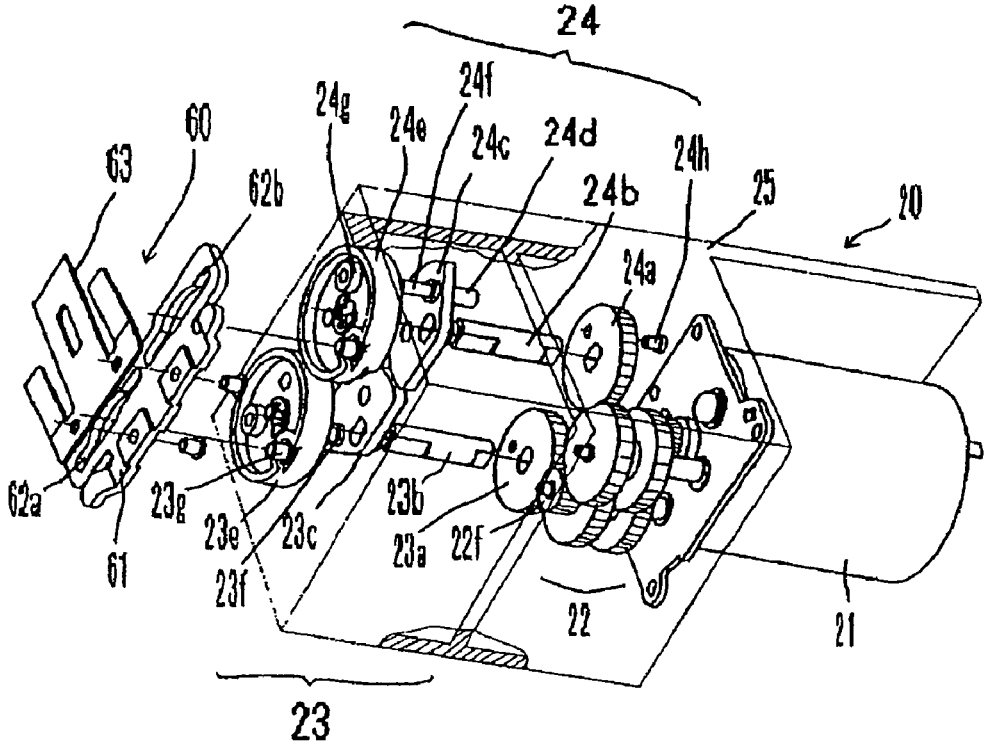
FIG. 4 is a perspective exploded view of the driver unit.
Figure 5:
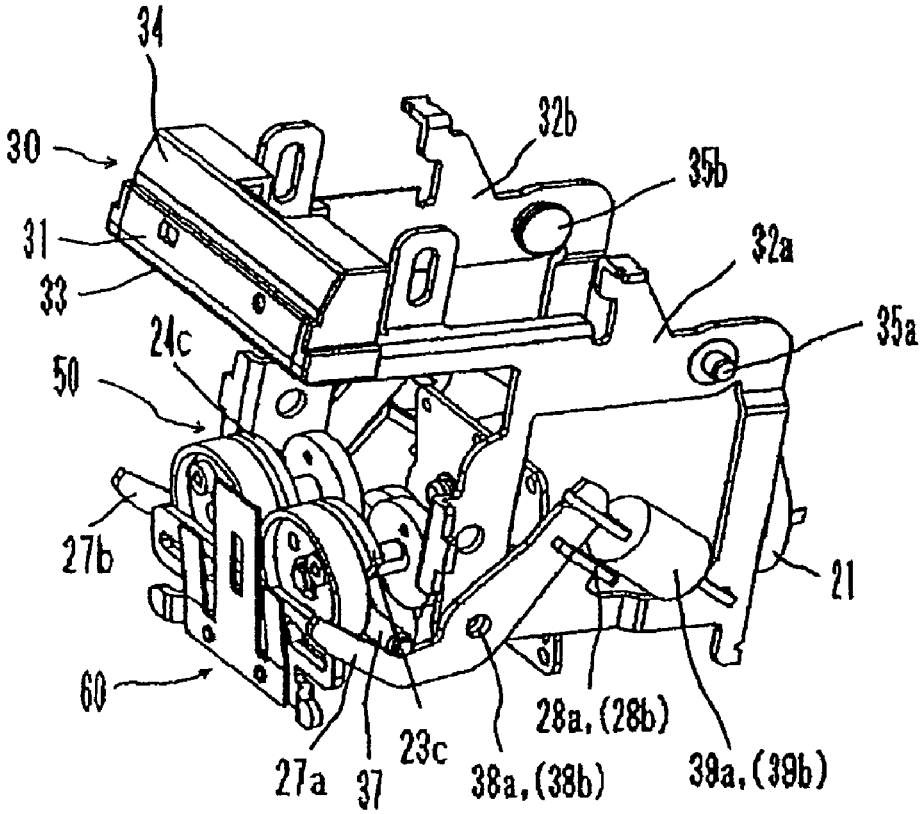
FIG. 5 is a perspective view of main units of the stapler apparatus, including a driver unit and an anvil unit.
Figure 6:
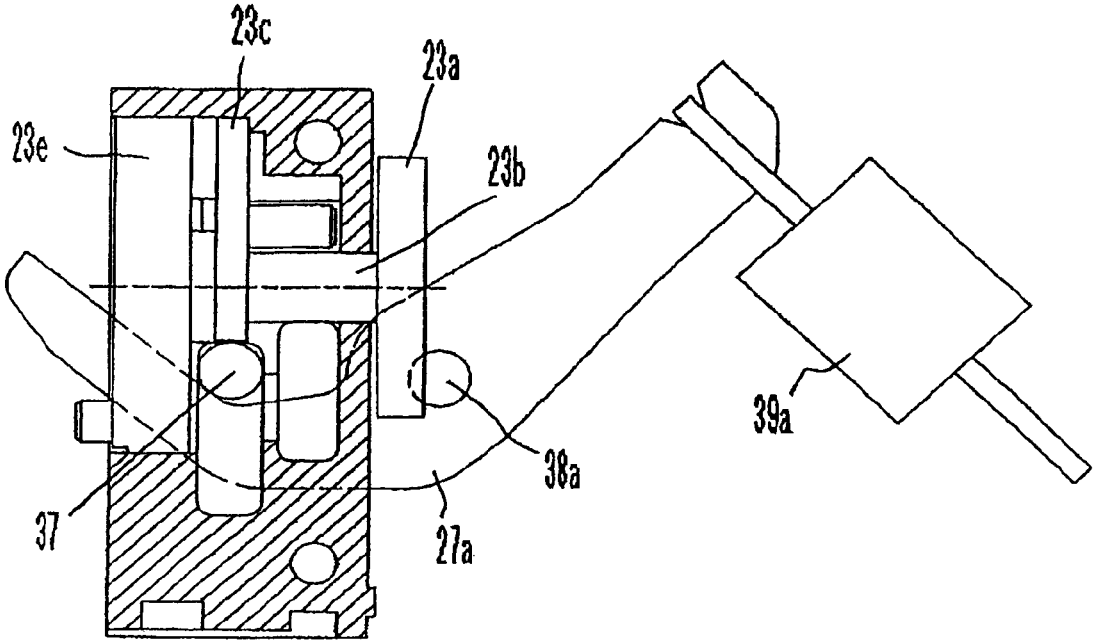
FIG. 6 is a cross-sectional view of main parts of cam members and operating levers.
Figure 7:
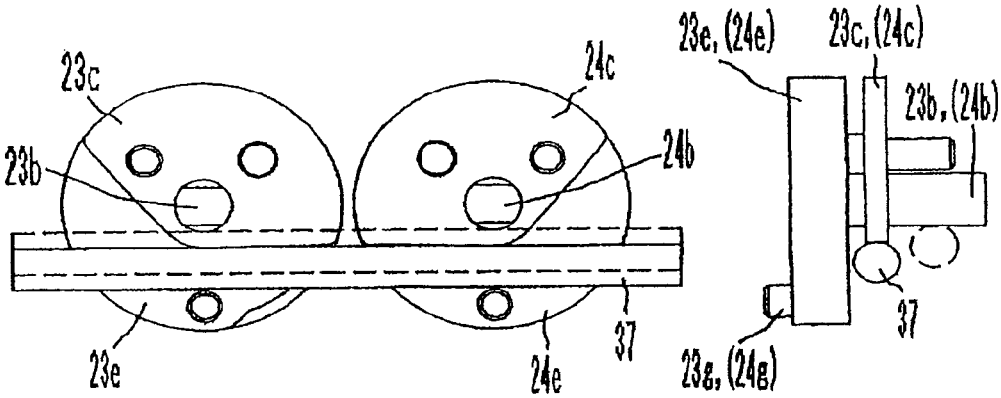
FIG. 7 is a view of main parts of an eccentric cam and an anvil swinging shaft.
Figure 8:
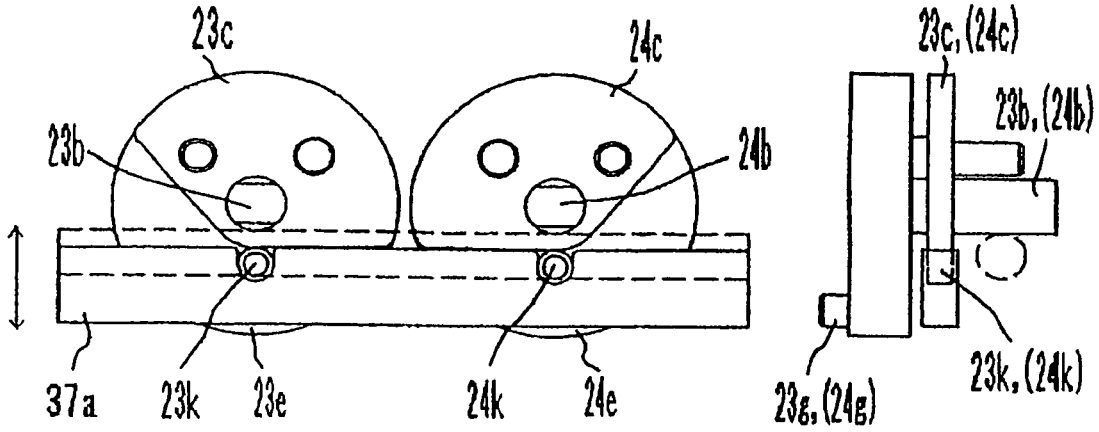
FIG. 8 is a view of main parts of another embodiment of the eccentric cams and the anvil swinging shaft.
Figure 9:
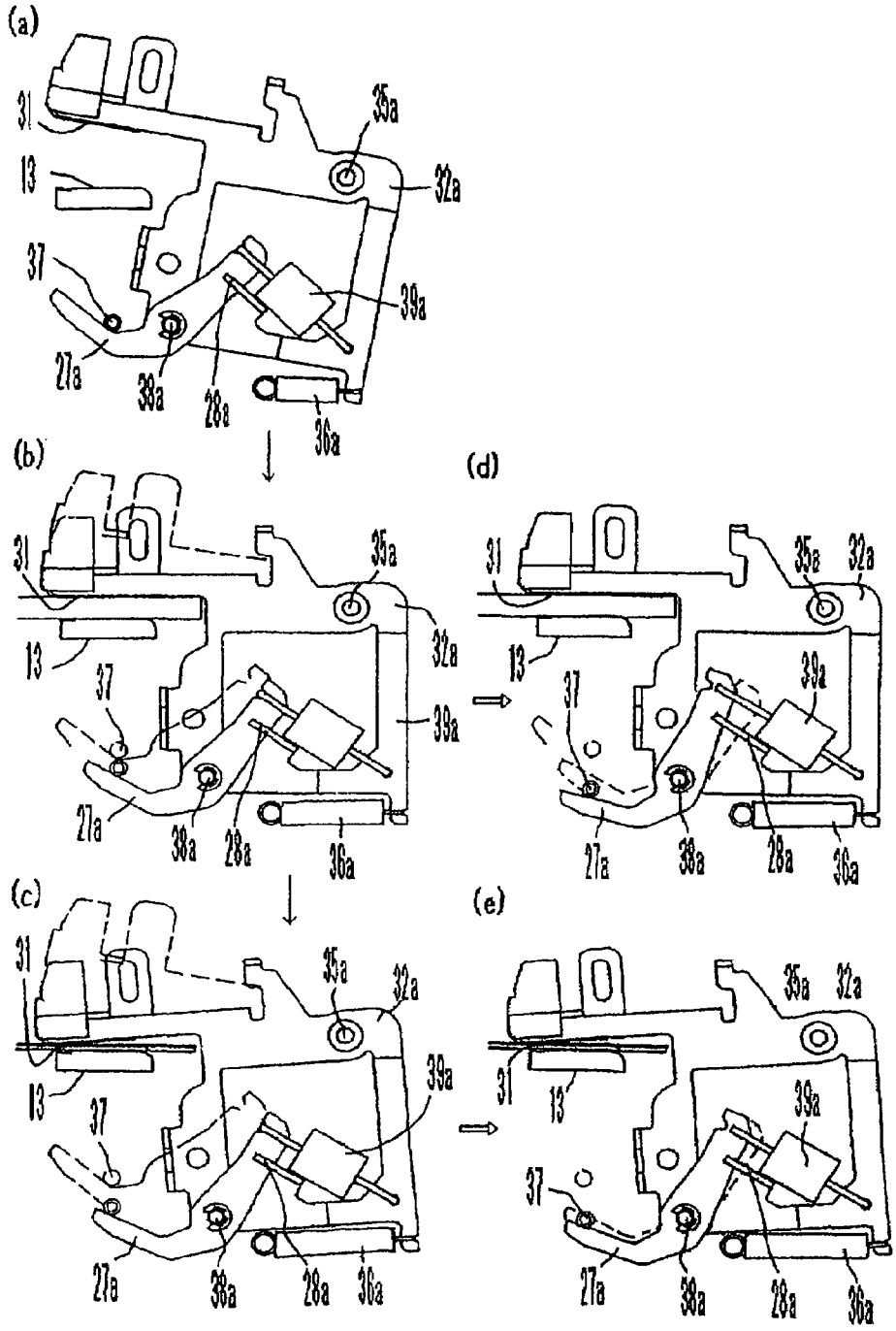
FIG. 9 is an illustration showing a clamping operation of a sheet bundle.
Figure 10:
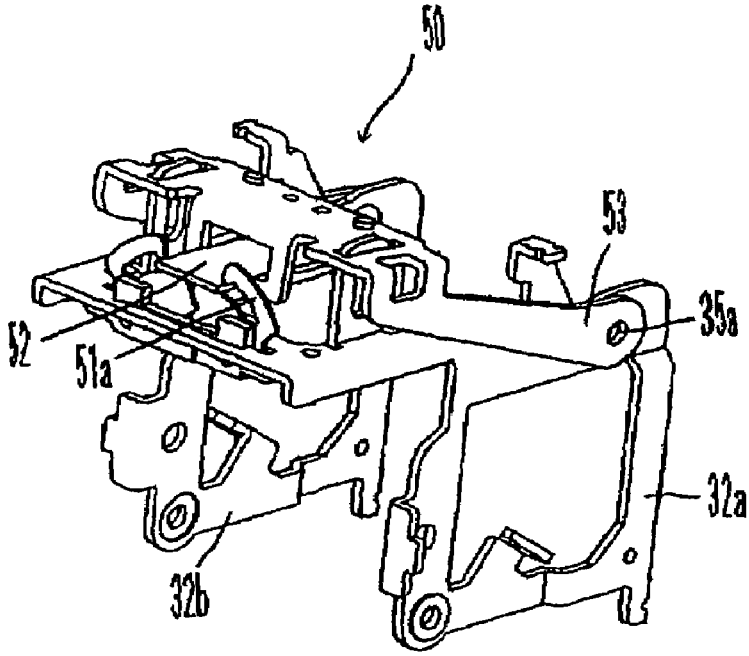
FIG. 10 is a perspective view of main parts of a clincher unit.
Figure 11:
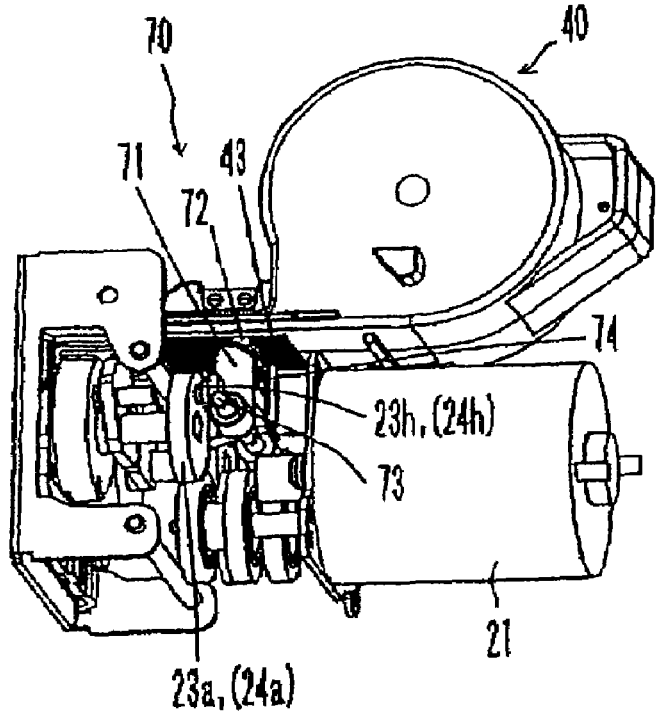
FIG. 11 is a perspective view of main parts of a staple feeding arrangement.
Figure 12:
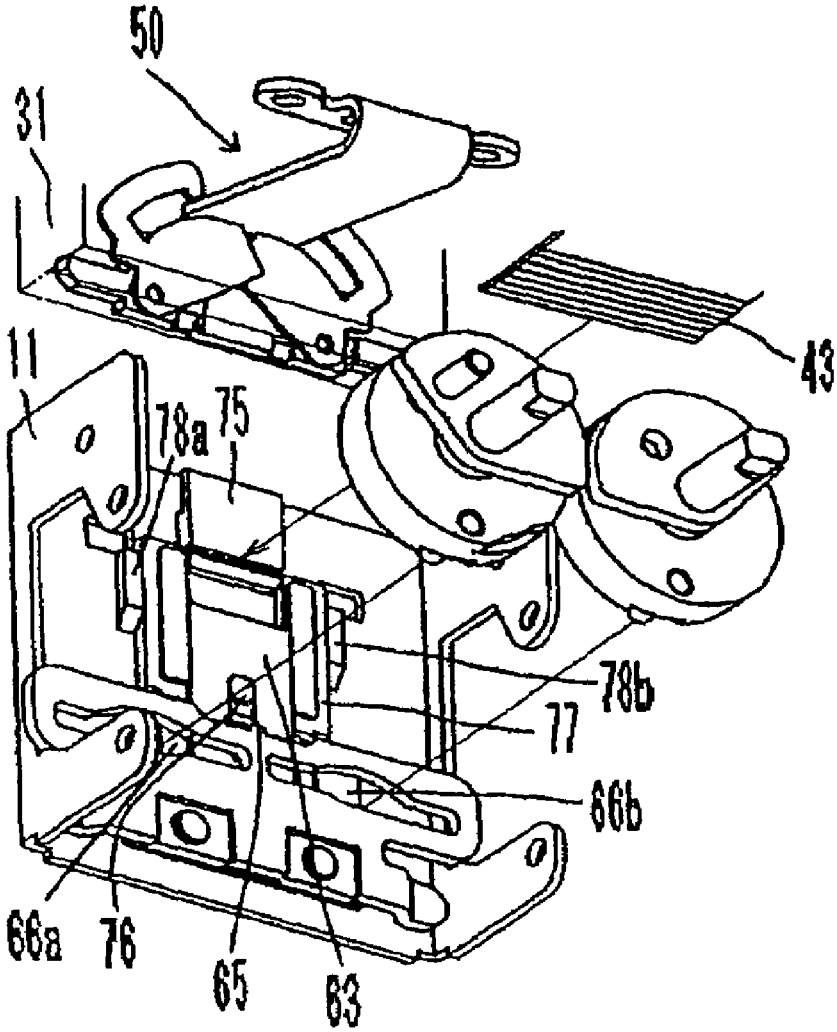
FIG. 12 is an illustration showing a forming structure of staples.
Figure 13:
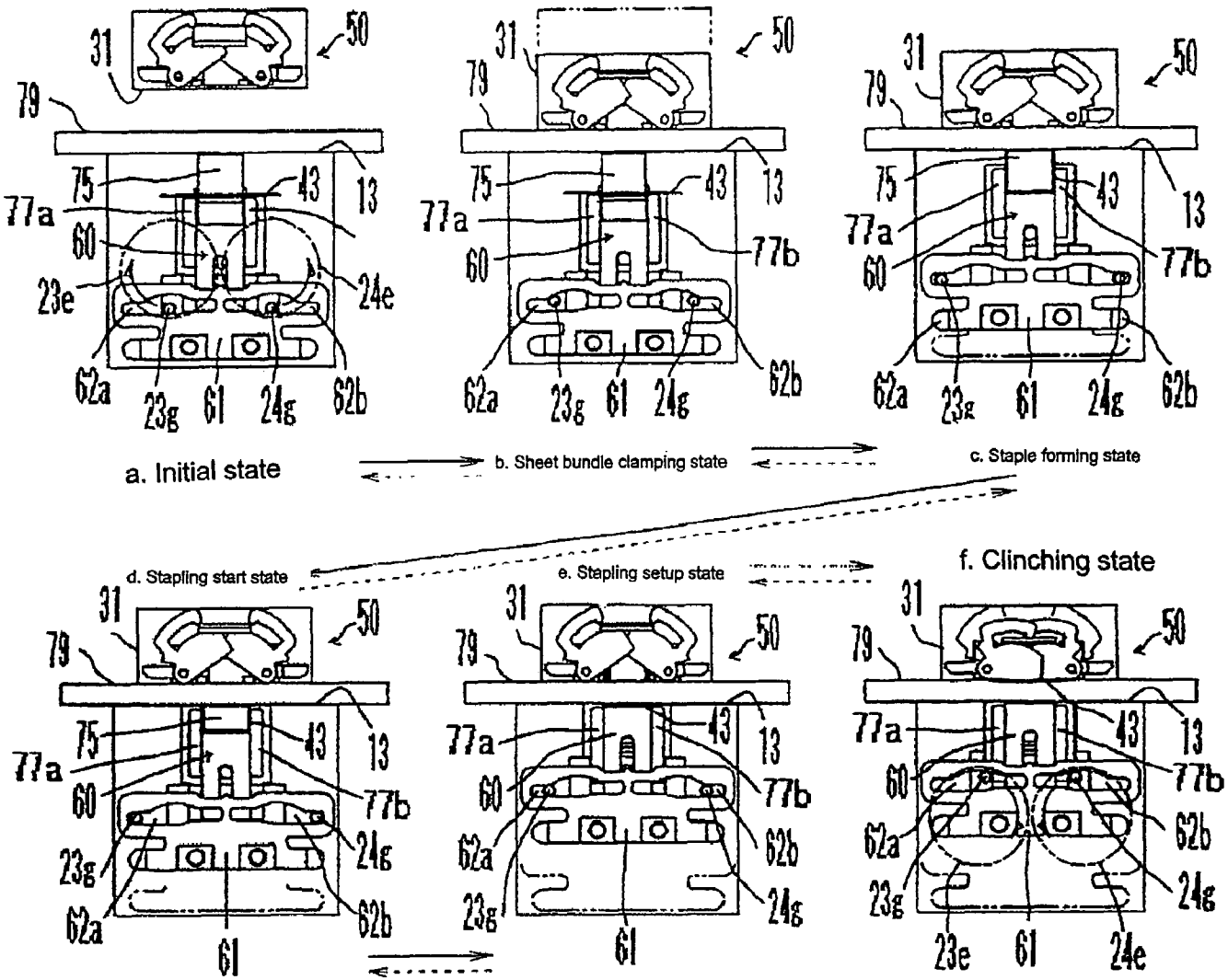
FIG. 13 is an illustration showing a sequential operation of the staples.
Figure 14:
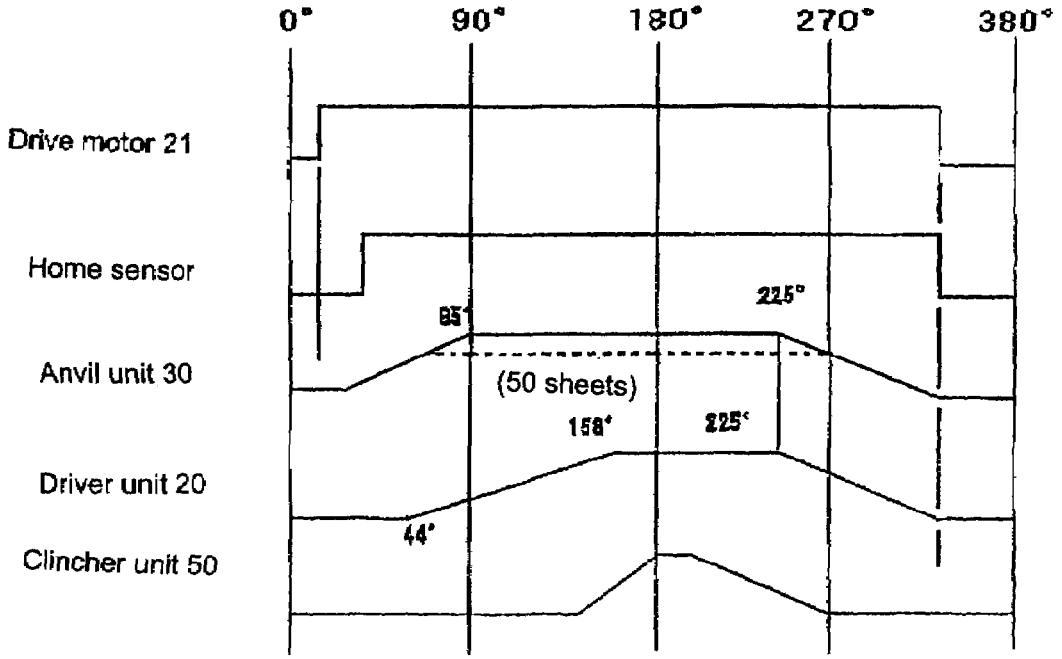
FIG. 14 is a timing chart showing the sequential operation of the staples in FIG. 11 above.

10=Stapler apparatus
20=Driver unit
21=Drive motor
23=First cam member
24=Second cam member
27*a* and 27*b*=Activating levers
28*a* and 28*b*=Abutting protrusions
30=Anvil unit
32*a* and 32*b*=Anvil arms
38*a* and 38*b*=Second swing pivots
39*a* and 39*b*=Second springs
40=Staple supply unit
50=Clincher unit
60=Driver
70=Staple feeding arrangement

The invention claimed is:

1. A stapler apparatus comprising:

a fixed frame;

a movable frame pivotably mounted to the fixed frame;

a staple driving device disposed on one of the fixed frame and the movable frame;

a staple bending device to bend the leading ends of staples, the staple bending device disposed on the other of the fixed frame and the movable frame;

a drive mechanism to reciprocally move the movable frame with respect to the fixed frame to clamp a stack of sheets between the fixed frame and the movable frame;

a transmission member movably supported on the movable frame at a first mounting location, the transmission member being free to move about the first mounting location without restriction by the fixed frame at any point of the transmission member spaced from the first mounting location, and an urging member disposed to bias the transmission member with respect to the movable frame, the transmission member being coupled to the drive mechanism such that the drive mechanism engages and moves the transmission member with respect to the movable frame, thereby overcoming the bias of the urging member, to compensate for a stack height of the stack of sheets clamped between the fixed frame and the movable frame.

2. The stapler apparatus of claim 1, wherein the transmission member is rotatably supported on the movable frame such that the transmission member can rotate with respect to the movable frame.

3. The stapler apparatus of claim 1, wherein the drive mechanism includes a drive cam.

4. The stapler apparatus of claim 1, wherein the transmission member includes an abutting portion configured to abut a protrusion on the movable frame, and wherein the urging member biases the abutting portion toward engagement with the protrusion on the movable frame.

5. The stapler apparatus of claim 4, wherein when the bias of the urging member is overcome, the abutting portion disengages the protrusion on the movable frame.

6. The stapler apparatus of claim 1, further comprising an activating member reciprocated by the drive mechanism and abutting the transmission member to move the transmission member.

7. The stapler apparatus of claim 1, wherein the urging member includes a spring connected to the transmission member and the movable frame.

8. The stapler apparatus of claim 1, wherein the transmission member includes a pair of transmission members positioned on opposite sides of the fixed frame.

9. The stapler apparatus of claim 1, further comprising a second urging member connected to the movable frame and the fixed frame to bias the movable frame with respect to the fixed frame.

10. The stapler apparatus of claim 1, wherein the transmission member is movably supported on the movable frame without any connection utilizing an elongated slot.

11. A stapler apparatus comprising:

a fixed frame;

a movable frame pivotably mounted to the fixed frame;

a staple driving device disposed on one of the fixed frame and the movable frame;

a staple bending device to bend the leading ends of staples, the staple bending device disposed on the other of the fixed frame and the movable frame;

a drive mechanism to reciprocally move the movable frame with respect to the fixed frame to clamp a stack of sheets between the fixed frame and the movable frame;

a transmission member movably supported on the movable frame without any connection utilizing an elongated slot, and an urging member disposed to bias the transmission member with respect to the movable frame, the transmission member being coupled to the drive mechanism such that the drive mechanism engages and moves the transmission member with respect to the movable frame, thereby overcoming the bias of the urging member, to compensate for a stack height of the stack of sheets clamped between the fixed frame and the movable frame.

12. The stapler apparatus of claim 11, wherein the transmission member is rotatably supported on the movable frame such that the transmission member can rotate with respect to the movable frame.

13. The stapler apparatus of claim 11, wherein the drive mechanism includes a drive cam.

14. The stapler apparatus of claim 11, wherein the transmission member includes an abutting portion configured to abut a protrusion on the movable frame, and wherein the urging member biases the abutting portion toward engagement with the protrusion on the movable frame.

15. The stapler apparatus of claim 14, wherein when the bias of the urging member is overcome, the abutting portion disengages the protrusion on the movable frame.

16. The stapler apparatus of claim 11, further comprising an activating member reciprocated by the drive mechanism and abutting the transmission member to move the transmission member.

17. The stapler apparatus of claim 1, wherein the urging member includes a spring connected to the transmission member and the movable frame.

18. The stapler apparatus of claim 1, wherein the transmission member includes a pair of transmission members positioned on opposite sides of the fixed frame.

19. The stapler apparatus of claim 1, further comprising a second urging member connected to the movable frame and the fixed frame to bias the movable frame with respect to the fixed frame.

20. The stapler apparatus of claim 1, wherein the transmission member is movably supported on the movable frame at a first mounting location, the transmission member being free to move about the first mounting location without restriction by the fixed frame at any point of the transmission member spaced from the first mounting location.

* * * * *

UNITED STATES PATENT AND TRADEMARK OFFICE

CERTIFICATE OF CORRECTION

PATENT NO. : 7,014,091 B2
APPLICATION NO. : 10/477306
DATED : March 21, 2006
INVENTOR(S) : Naoto Mochizuki It is certified that error appears in the above-identified patent and that said Letters Patent is hereby corrected as shown below:

Under EMBODIMENTS, Column 6, line 55, “Step 3” should be -- “Step e”--.

Claim 17, column 12, line 1, “claim 1” should be -- claim 11--.

Claim 18, column 12, line 4, “claim 1” should be -- claim 11--.

Claim 19, column 12, line 7, “claim 1” should be -- claim 11--.

Claim 20, column 12, line 11, “claim 1” should be -- claim 11--.

Signed and Sealed this

Eighteenth Day of July, 2006

JON W. DUDAS
*Director of the United States Patent and Trademark Office*